US012209226B2

(12) United States Patent
Shih et al.

(10) Patent No.: US 12,209,226 B2
(45) Date of Patent: Jan. 28, 2025

(54) FUEL ADDITIVES FOR REDUCING LOW SPEED PRE-IGNITION EVENTS

(71) Applicants: CHEVRON ORONITE COMPANY LLC, San Ramon, CA (US); CHEVRON U.S.A. INC., San Ramon, CA (US)

(72) Inventors: Jiun-Le Shih, El Sobrante, CA (US); Chung-Hao Kuo, Albany, CA (US); Charles Paul Loeper, Berkeley, CA (US); Jeanelle Smoot, South San Francisco, CA (US)

(73) Assignees: CHEVRON ORONITE COMPANY LLC, San Ramon, CA (US); CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/264,083

(22) PCT Filed: Mar. 24, 2022

(86) PCT No.: PCT/IB2022/052717

§ 371 (c)(1),
(2) Date: Aug. 3, 2023

(87) PCT Pub. No.: WO2022/208251

PCT Pub. Date: Oct. 16, 2022

(65) Prior Publication Data

US 2024/0101922 A1 Mar. 28, 2024

Related U.S. Application Data

(60) Provisional application No. 63/168,446, filed on Mar. 31, 2021.

(51) Int. Cl.

| | |
|---|---|
| ***C10M 133/08*** | (2006.01) |
| ***C10L 1/22*** | (2006.01) |
| ***C10M 141/06*** | (2006.01) |

(52) U.S. Cl.

CPC ..... *C10M 133/08* (2013.01); *C10L 1/22* (2013.01); *C10M 141/06* (2013.01); *C10L 2200/0423* (2013.01); *C10L 2270/023* (2013.01); *C10M 2215/062* (2013.01); *C10M 2215/221* (2013.01)

(58) Field of Classification Search

CPC ..... C10M 133/08; C10M 141/06; C10M 2215/062; C10M 2215/221; C10L 1/22; C10L 2200/0423; C10L 2270/023

See application file for complete search history.

(56) References Cited

U.S. PATENT DOCUMENTS

| | | | | |
|---|---|---|---|---|
| 4,322,304 | A | 3/1982 | Parlman et al. | |
| 2006/0234880 | A1* | 10/2006 | Chiverton | C08F 8/32 508/542 |
| 2014/0259884 | A1* | 9/2014 | Sunkara | C10M 129/94 44/388 |

FOREIGN PATENT DOCUMENTS

| | | |
|---|---|---|
| EP | 1712570 | 10/2006 |
| EP | 3571267 | 11/2019 |
| RU | 2384567 | * 3/2010 |
| WO | 2018118477 | 6/2018 |

OTHER PUBLICATIONS

International Search Report, issued on Jun. 28, 2022, during the prosecution of International Application No. PCT/IB2022/052717.
Written Opinion of the International Searching Authority, , issued on Jun. 28, 2022, during the prosecution of International ApplicationNo. PCT/IB2022/052717.

* cited by examiner

*Primary Examiner* — Cephia D Toomer

(57) ABSTRACT

Method for preventing or reducing low speed pre-ignition events in a spark-ignited internal combustion engine is provided. The method includes supplying to the engine the lubricant composition comprising a primary additive having a structure given by

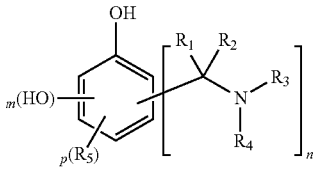

or a salt thereof. $R_1$ and $R_2$ are independently H, $C_1$-$C_{20}$ hydrocarbyl group, carboxyl group, ester, amide, ketone, ether, or hydroxyl group. $R_3$ and $R_4$ are independently H, $C_1$-$C_{20}$ hydrocarbyl group, carboxyl group, ester, amide, ketone, ether, amino, or hydroxyl group or wherein $R_3$ and $R_4$ are part of a cyclic group. $R_5$ is $C_1$-$C_{100}$ hydrocarbyl group, carboxyl group, ether, or hydroxyl group. Lastly, p is 0 to 2, n is 1 to 5, m is 0 to 2, and p+n+m is less than 6.

16 Claims, No Drawings

FUEL ADDITIVES FOR REDUCING LOW SPEED PRE-IGNITION EVENTS

TECHNICAL FIELD

This disclosure relates to fuel additives and fuel compositions for direct-injection engines and methods for preventing or reducing low speed pre-ignition events using the same.

BACKGROUND

Turbocharged or supercharged engines (i.e., boosted internal combustion engines) may exhibit an abnormal combustion phenomenon known as stochastic pre-ignition or low-speed pre-ignition (or "LSPI"). LSPI can lead to high in-cylinder pressures and advanced combustion phasing which can cause severe knocking intensity. In worst case scenarios, LSPI can cause catastrophic engine damage. However, because LSPI events occur only sporadically and in an uncontrolled fashion, it is difficult to identify the causes for this phenomenon and to develop solutions to suppress it.

One possible explanation of LSPI is that the events are caused at least in part by auto-ignition of engine oil droplets that enter the engine combustion chamber from the piston crevice under high pressure, during periods in which the engine is operating at low speeds and compression stroke time is longest.

While there is active research and development of new engine technology, such as electronic controls and knock sensors, that attempt to address LSPI, there is also a need for fuel and/or lubricating oil compositions that can reduce or eliminate LSPI.

SUMMARY

In one aspect, there is provided a method for preventing or reducing low speed pre-ignition events in a spark-ignited internal combustion engine, the method comprising: supplying to the engine the lubricant composition comprising a primary additive having a structure given by

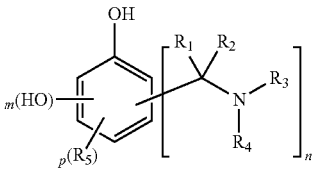

or a salt there of; wherein $R_1$ and $R_2$ are independently H, $C_1$-$C_{20}$ hydrocarbyl group, carboxyl group, ester, amide, ketone, ether, or hydroxyl group; wherein $R_3$ and $R_4$ are independently H, $C_1$-$C_{20}$ hydrocarbyl group, carboxyl group, ester, amide, ketone, ether, amino, or hydroxyl group or wherein $R_3$ and $R_4$ are part of a cyclic group; $R_5$ is $C_1$-$C_{100}$ hydrocarbyl group, carboxyl group, ether, or hydroxyl group; and wherein p is 0 to 2, n is 1 to 5, m is 0 to 2, and p+n+m is less than 6.

In another aspect, there is provided a method for preventing or reducing low speed pre-ignition events in a spark-ignited internal combustion engine, the method comprising: lubricating the engine the lubricant composition comprising a phenolic amine having a structure given by

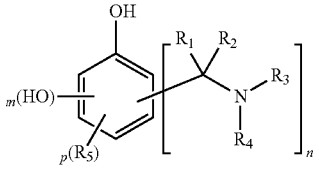

or a salt there of; wherein $R_1$ and $R_2$ are independently H, $C_1$-$C_{20}$ hydrocarbyl group, carboxyl group, ester, amide, ketone, ether, or hydroxyl group; wherein $R_3$ and $R_4$ are independently H, $C_1$-$C_{20}$ hydrocarbyl group, carboxyl group, ester, amide, ketone, ether, amino, or hydroxyl group or wherein $R_3$ and $R_4$ are part of a cyclic group; $R_5$ is $C_1$-$C_{100}$ hydrocarbyl group, carboxyl group, ether, or hydroxyl group; wherein p is 0 to 2, n is 1 to 5, m is 0 to 2, and p+n+m is less than 6; and optionally a second additive or a salt thereof, wherein the second additive is an acid, phenol, 1,3 dicarbonyl, hydroxyamide, antioxidant, salicylate, or amidine.

DETAILED DESCRIPTION

Introduction

In this specification, the following words and expressions, if and when used, have the meanings ascribed below.

"Gasoline" or "gasoline boiling range components" refers to a composition containing at least predominantly $C_4$-$C_{12}$ hydrocarbons. In one embodiment, gasoline or gasoline boiling range components is further defined to refer to a composition containing at least predominantly $C_4$-$C_{12}$ hydrocarbons and further having a boiling range of from about 100° F. (37.8° C.) to about 400° F. (204° C.). In an alternative embodiment, gasoline or gasoline boiling range components is defined to refer to a composition containing at least predominantly $C_4$-$C_{12}$ hydrocarbons, having a boiling range of from about 100° F. (37.8° C.) to about 400° F. (204° C.), and further defined to meet ASTM D4814.

The term "oil soluble" means that for a given additive, the amount needed to provide the desired level of activity or performance can be incorporated by being dissolved, dispersed or suspended in an oil of lubricating viscosity. Usually, this means that at least 0.001% by weight of the additive can be incorporated in a lubricating oil composition. The term "fuel soluble" is an analogous expression for additives dissolved, dispersed or suspended in fuel.

A "minor amount" means less than 50 wt % of a composition, expressed in respect of the stated additive and in respect of the total weight of the composition, reckoned as active ingredient of the additive.

An "engine" or a "combustion engine" is a heat engine where the combustion of fuel occurs in a combustion chamber. An "internal combustion engine" is a heat engine where the combustion of fuel occurs in a confined space ("combustion chamber"). A "spark ignition engine" is a heat engine where the combustion is ignited by a spark, usually from a spark plug. This is contrast to a "compression-ignition engine," typically a diesel engine, where the heat generated from compression together with injection of fuel is sufficient to initiate combustion without an external spark.

Low Speed Pre-Ignition (LSPI)

Low Speed Pre-Ignition (LSPI) is most or more likely to occur in direct-injected, boosted (turbocharged or supercharged), spark-ignited (gasoline) internal combustion engines that, in operation, generate a brake mean effective pressure level of greater than 1000 kPa (10 bar) at engine speeds of from 1500 to 2500 rotations per minute (rpm), such as at engine speeds of from 1500 to 2000 rpm. "Brake mean effective pressure" (BMEP) is defined as the work accomplished during on engine cycle, divided by the engine swept volume, the engine torque normalized by engine displacement. The word "brake" denotes the actual torque or power available at the engine flywheel, as measured on a dynamometer. Thus, BMEP is a measure of the useful energy output of the engine.

It has now been found that the fuel additives or lubricating oil additives of this disclosure which are particularly useful in high pressure spark-ignited internal combustion engines and, when used in the high pressure spark-ignited internal combustion engines, will prevent or minimize engine knocking and pre-ignition problems.

Phenolic Amines

The fuel or lubricant additives of the present invention includes phenolic amine compositions that have the following generalized Structure 1 or a salt thereof:

Structure 1

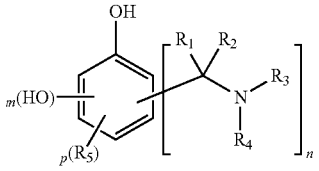

For structure 1, p is defined as being 0 to 2, n is defined as being 1 to 5 and m is defined as being 0 to 2, wherein p+n+m<6. Each $R_1$ and $R_2$ is independently a hydrogen, $C_1$-$C_{20}$ hydrocarbyl group, carboxyl group (e.g., carboxylic acid, ester, amide, and ketone), ether, or hydroxyl group. Each $R_3$ and $R_4$ is independently a hydrogen, $C_1$-$C_{20}$ hydrocarbyl group, a carboxyl group (e.g., carboxylic acid, ester, amide, and ketone), ether, amino or hydroxyl group. In some embodiments, $R_3$ and $R_4$ may form a cyclic group. $R_5$ is $C_1$-$C_{100}$ hydrocarbyl group, carboxyl group, ether, or hydroxyl group. In some embodiments, the cyclic group may include one or more nitrogens or one or more oxygens.

The phenolic amine compositions of the present invention may be obtained commercially or synthesized by any known method. For example, one or more phenolic amine additives of the present invention may be synthesized via a Mannich reaction which typically involve amino alkylation of a carbonyl function group by an aldehyde. A detailed description of Mannich reaction can be found in, for example, U.S. Pat. No. 7,351,864, which is hereby incorporated by reference.

Compatible phenolic amine compositions include, for example, 2,4,6-tris(dimethyl aminomethyl)phenol (Structure 2A), 2-[(Dimethylamino)methyl]phenol (Structure 2B), 4-(tert-butyl)-2,6-bis((dimethylamino)methyl)phenol (Structure 2C), and 2-(tert-butyl)-4,6-bis((dimethylamino)methyl)phenol (Structure 2D).

Structure 2A

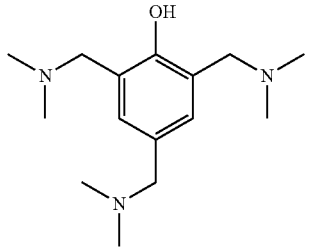

Structure 2B

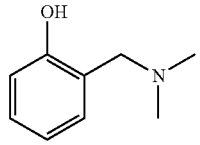

Structure 2C

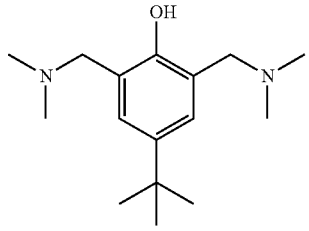

Structure 2D

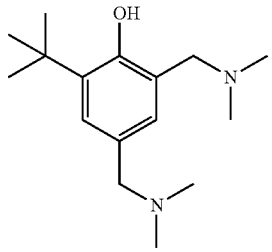

In some embodiments, the phenolic amine may be present in salt form. The salt of Structure 1 is typically the protonated form (i.e., ammonium). In some embodiments, the phenolic amine additive may be present in salt form, wherein the phenolic amine additive is coordinated to one or more secondary LSPI-reducing additives. The synergistic interaction of the phenolic amine and secondary additive can provide greater than expected LSPI reduction.

The following are descriptions of secondary additives that can be utilized as fuel or lubricating additives to reduce LSPI activity. In general, a secondary LSPI-reducing additive, a substituted secondary LSPI-reducing additive, or a derivative thereof will be used in their salt form and in combination with a primary additive to reduce LSPI activity. For example, phenolic amine and aliphatic acid (secondary additive) can be combined and utilized as an LSPI additive.

Acid Additives

Aliphatic Acid

Aliphatic acids are non-aromatic carboxylic acids. Suitable aliphatic acids include mono-carboxylic acids having the following structure Structure 3

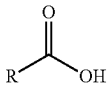

wherein R is an aliphatic group having between 2 to 20 carbon atoms. The aliphatic group may be linear or branched and may contain heteroatoms.

Suitable aliphatic acids include hexanoic acid (Structure 3A), heptanoic acid (Structure 3B), octanoic acid (Structure 3C), nonanoic acid (Structure 3D), decanoic acid (Structure 3E), undecanoic acid, lauric acid, myristic acid, palmitic acid, stearic acid, arachidic acid ($C_{20}$), behenic acid ($C_{22}$), 2-ethylbutyric acid (Structure 3F), 3,3-dimethylbutyric acid, 2-methylpentanoic acid ($C_6$), 2-methylhexanoic acid ($C_7$), 4-methylhexanoic acid ($C_7$), 5-methylhexanoic acid ($C_7$), 2,2-dimethylpentanoic acid ($C_7$), 2-propylpentanoic acid (C), 2-ethylhexanoic acid (Structure 3G), 2-methylheptanoic acid (C), isooctanoic acid (C), 3,5,5-trimethylhexanoic acid ($C_9$), 4-methyloctanoic acid ($C_9$), 4-methylnonanoic acid, ($C_{10}$), isodecanoic acid ($C_{10}$), 2-butyloctanoic acid ($C_{12}$), isotridecanoic acid ($C_{13}$), 2-hexyldecanoic acid ($C_{16}$), isopalmitic acid ($C_{16}$), isostearic acid (Structure 3H), 3-cyclohexylpropionic acid, 4-cyclohexylbutyric acid (Structure 31), and cyclohexanepentanoic acid. Representative structures are shown below.

Structure 3A

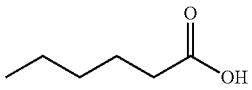

Structure 3B

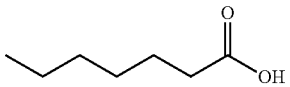

Structure 3C

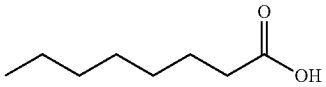

Structure 3D

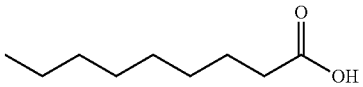

Structure 3E

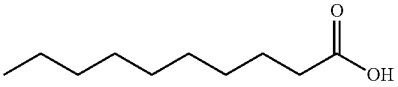

Structure 3F

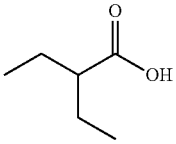

Structure 3G

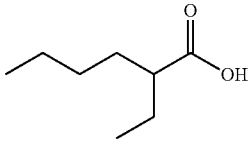

Structure 3H

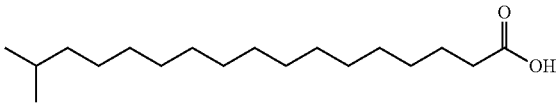

Structure 3I

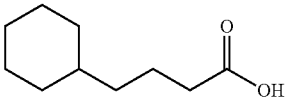

-continued

Structure 3J

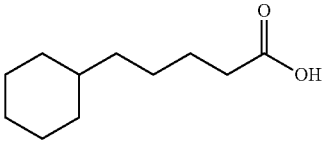

Unsaturated Acid

Suitable unsaturated acids include any organic acids that contain double or triple carbon-carbon bond. Representative unsaturated acids include maleic acid (Structure 4A), fumaric acid (Structure 4B), as well as unsaturated fatty acids such as palmitoleic acid (Structure 4C) and oleic acid (Structure 4D). Representative structures are shown below.

Structure 4A

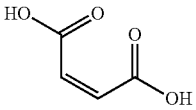

Structure 4B

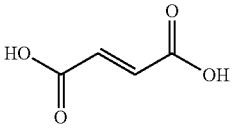

Structure 4C

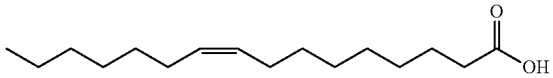

Structure 4D

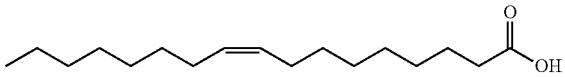

Alkylaromatic Acid

Suitable alkylaromatic acids include both mono-carboxylic acids and dicarboxylic acids. The alkyl carboxylic acid may have 6 or more carbon atoms (e.g., 6 to 24 carbon atoms, 6 to 20 carbon atoms, 8 to 24 carbon atoms, 8 to 20 carbon atoms, or even 8 to 18 carbon atoms). The alkyl moiety may be optionally substituted with one or more substituents such as hydroxy, alkoxy and carbonyl (e.g., aldehydic or ketonic) groups. Suitable examples of alkylaromatic acid include methylbenzoic acid (Structure 5A) and ethylbenzoic acid (Structure 5B). Representative structures are shown below.

Structure 5A

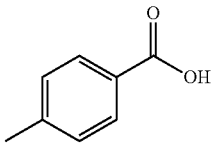

Structure 5B

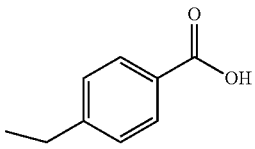

-continued

Structure 5C

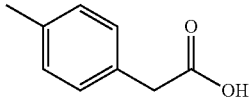

Aromatic Acid

Suitable aromatic acids include both mono-carboxylic acids and dicarboxylic acids. The alkyl carboxylic acid may have 6 or more carbon atoms (e.g., 6 to 24 carbon atoms, 6 to 20 carbon atoms, 8 to 24 carbon atoms, 8 to 20 carbon atoms, or even 8 to 18 carbon atoms). The alkyl moiety may be optionally substituted with one or more substituents such as hydroxy, alkoxy and carbonyl (e.g., aldehydic or ketonic) groups. Suitable aromatic acids include benzoic acid (Structure 6A), hydroxybenzoic acid (Structure 6B), and tetralin carboxylic acid (Structure 6C).

Representative structures are shown below.

Structure 6A

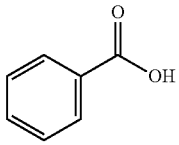

Structure 6B

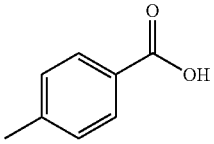

Structure 6C

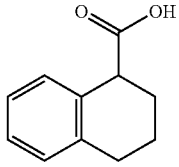

Hydroxy Acid

Suitable hydroxy acids include those that can be represented by the following general formula:

Structure 7

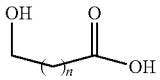

wherein n=1 to 3. Suitable examples of hydroxy acid include glycolic acid (Structure 7A), lactic acid (Structure 7B), malic acid (Structure 7C), tartaric acid (Structure 7D), and citric acid (Structure 7E). Representative structures are shown below.

Structure 7A

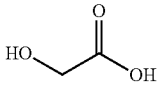

-continued

Structure 7B

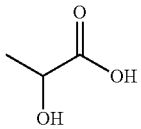

Structure 7C

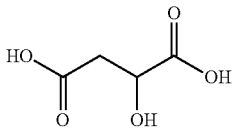

Structure 7D

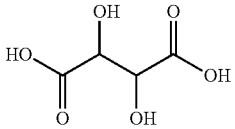

Structure 7E

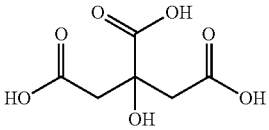

Amino Acid

Amino acids can be utilized as primary and/or secondary additives. Suitable amino acids were previously described above.

Phenol Additives

Phenol

Suitable phenols include, thymol (Structure 8A), eugenol (Structure 8B), hydroquinone (Structure 8C), resorcinol (Structure 8D), cresol (Structure 8E) and 2-methylquinolin-8-ol (Structure 8G). Representative structures are shown below.

Structure 8A

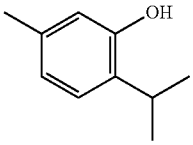

Structure 8B

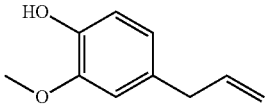

Structure 8C

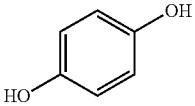

Structure 8D

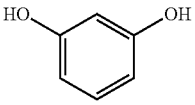

Structure 8E

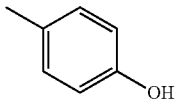

-continued

Structure 8F

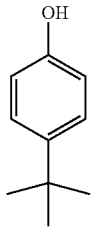

Structure 8G

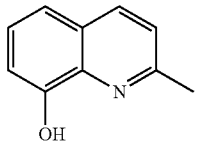

1,3 Dicarbonyl Additives 1,3 Diketone

Suitable examples of 1,3 diketone compounds include acetylacetone (Structure 9A), and curcumin (Structure 9B). Representative structures are shown below.

Structure 9A

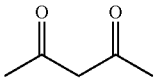

Structure 9B

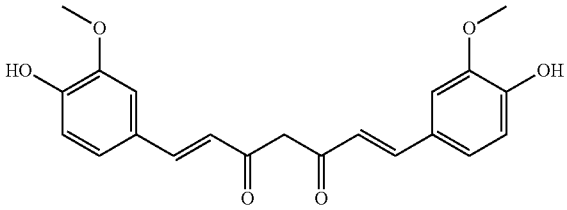

1,3 Ketoester

Suitable 1,3 ketoesters are shown below.

Structure 10A

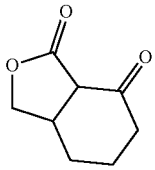

Structure 10B

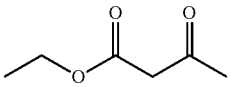

Hydroxamide Additives

A hydroxamide is a hydroxy derivative of an amide. Useful hydroxamides include those that can be represented by the following general formula:

Structure 11

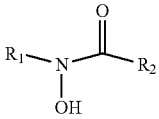

wherein $R_1$ and $R_2$ are each independently selected from hydrogen or $C_1$-$C_{20}$ (e.g., $C_3$-$C_{12}$) alkyl group. Suitable hydroxamide includes hydroxy methylacetamide (Formula 21A). Representative structures are shown below.

Structure 11A

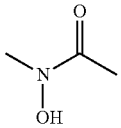

Structure 11B

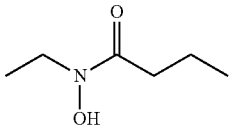

Structure 11C

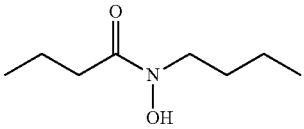

Antioxidant Additives

Suitable antioxidants include both mono-carboxylic acids and dicarboxylic acids. The alkyl carboxylic acid may have 6 or more carbon atoms (e.g., 6 to 24 carbon atoms, 6 to 20 carbon atoms, 8 to 24 carbon atoms, 8 to 20 carbon atoms, or even 8 to 18 carbon atoms). The alkyl moiety may be optionally substituted with one or more substituents such as hydroxy, alkoxy and carbonyl (e.g., aldehydic or ketonic) groups. Suitable antioxidants include the following.

Structure 12

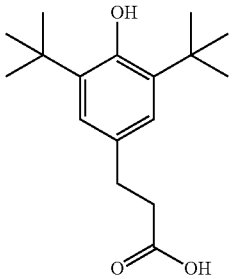

Salicylate Additives

Salicylate

Suitable salicylates include 2-hydroxy-5-(tetracosa-1,3,5,7,9,11,13,15,17,19,21,23-dodecayn-1-yl)benzoic acid-dihydrogen (Structure 13E). Suitable salicylates are shown below.

Structure 13A

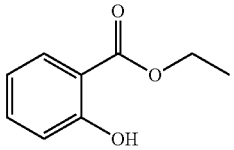

Structure 13B

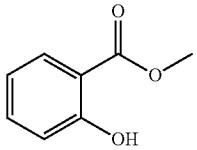

Structure 13C

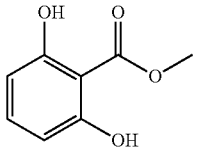

Structure 13D

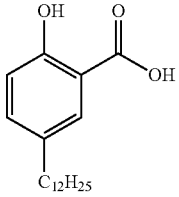

Structure 13E

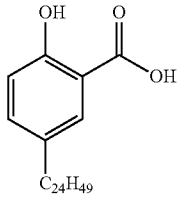

Amidine

The fuel additive or lubricating oil additive of this disclosure may be an amidine, a substituted amidine, or a derivative thereof or an acceptable salt thereof. Useful amidines include those that can be represented by the following general formula:

Structure 14

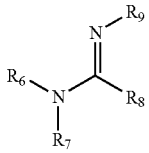

wherein $R_6$, $R_7$, $R_8$ and $R_9$ are each independently selected from hydrogen, monovalent organic groups, monovalent heterorganic groups (e.g., comprising nitrogen, oxygen, sulfur or phosphorus, in the form of groups or moieties that are bonded through a carbon atom and that do not contain acid functionality such as carboxylic or sulfonic), and combinations thereof; and wherein any two or more of $R_6$, $R_7$, $R_8$ and $R_9$ optionally can be bonded together to form a cyclic structure (e.g., a five-, six, or seven-membered ring). The cyclic structures may be aromatic or non-aromatic, as well as vary from being fully saturated to fully unsaturated. The organic and heterorganic groups may have from 1 to 10 carbon atoms (e.g., 1 to 6 carbon atoms).

Representative examples of suitable amidines include 1,4,5,6-tetrahydropyrimidine (Structure 14A), 1,2-dimethyl-1,4,5,6-tetrahydropyrimidine (Structure 14B), 1,2-diethyl-1,4,5,6-tetrahydropyrimidine (Structure 14C), 1,5-diazabicyclo[4.3.0]non-5-ene (DBN; Structure 14D), 1,8-diazabicyclo[5.4.0]-undeca-7-ene (DBU; Structure 14E), benzamidine (Structure 14F), benzimidazole (Structure 14G) and 2-phenyl-1H-benzo[d]imidazole (Structure 14M). Representative structures are shown below.

Structure 14A

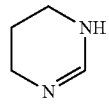

Structure 14B

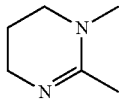

Structure 14C

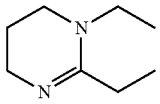

Structure 14D

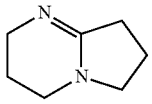

Structure 14E

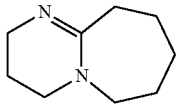

Structure 14F

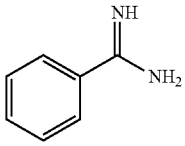

Structure 14G

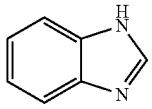

Structure 14H

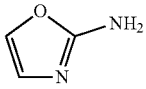

Structure 14I

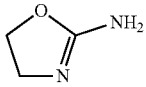

Structure 14J

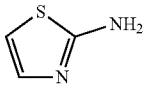

Structure 14K

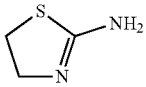

-continued

Structure 14L

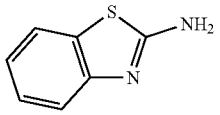

Structure 14M

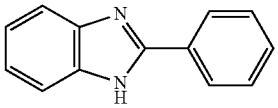

Salts

The salts of this disclosure may be prepared by conventional means, for example, by mixing the primary additive with a suitable secondary additive in an aprotic solvent. The order in which one additive is added to the other is not important. The primary additive and secondary additive are usually mixed together in an approximately equimolar ratio. An excess of the primary or secondary additive component may be used. For example, the molar ratio of base relative to the alkyl carboxylic acid may be about 1.05:1 to 2:1 (e.g., 1.1:1 to 1.5:1).

Fuel Compositions

The compounds of the present disclosure may be useful as additives in hydrocarbon fuels to prevent or reduce engine knock or pre-ignition events in spark-ignited internal combustion engines.

The concentration of the compounds of the present disclosure in hydrocarbon fuel may range from 25 to 5000 parts per million (ppm) by weight (e.g., 50 to 1000 ppm).

The compounds of the present disclosure may be formulated as a concentrate using an inert stable oleophilic (i.e., soluble in hydrocarbon fuel) organic solvent boiling in a range of 65° C. to 205° C. An aliphatic or an aromatic hydrocarbon solvent may be used, such as benzene, toluene, xylene, or higher-boiling aromatics or aromatic thinners. Aliphatic alcohols containing 2 to 8 carbon atoms, such as ethanol, isopropanol, methyl isobutyl carbinol, n-butanol and the like, in combination with the hydrocarbon solvents are also suitable for use with the present additives. In the concentrate, the amount of the additive may range from 10 to 70 wt % (e.g., 20 to 40 wt %).

In gasoline fuels, other well-known additives can be employed including oxygenates (e.g., ethanol, methyl tert-butyl ether), other anti-knock agents, and detergents/dispersants (e.g., hydrocarbyl amines, hydrocarbyl poly(oxyalkylene) amines, succinimides, Mannich reaction products, aromatic esters of polyalkylphenoxyalkanols, or polyalkylphenoxyaminoalkanes). Additionally, friction modifiers, antioxidants, metal deactivators and demulsifiers may be present.

In diesel fuels, other well-known additives can be employed, such as pour point depressants, flow improvers, cetane improvers, and the like.

A fuel-soluble, non-volatile carrier fluid or oil may also be used with compounds of this disclosure. The carrier fluid is a chemically inert hydrocarbon-soluble liquid vehicle which substantially increases the non-volatile residue (NVR), or solvent-free liquid fraction of the fuel additive composition while not overwhelmingly contributing to octane requirement increase. The carrier fluid may be a natural or synthetic oil, such as mineral oil, refined petroleum oils, synthetic polyalkanes and alkenes, including hydrogenated and unhydrogenated polyalphaolefins, synthetic polyoxyalkylene-derived oils, such as those described in U.S. Pat. Nos. 3,756,793; 4,191,537; and 5,004,478; and in European Patent Appl. Pub. Nos. 356,726 and 382,159.

The carrier fluids may be employed in amounts ranging from 35 to 5000 ppm by weight of the hydrocarbon fuel (e.g., 50 to 3000 ppm of the fuel). When employed in a fuel concentrate, carrier fluids may be present in amounts ranging from 20 to 60 wt % (e.g., 30 to 50 wt %).

Lubricating Oil Compositions

The compounds of the present disclosure may be useful as additives in lubricating oils to prevent or reduce engine knock or pre-ignition events in spark-ignited internal combustion engines.

The concentration of the compounds of the present disclosure in the lubricating oil composition may range from 0.01 to 15 wt % (e.g., 0.5 to 5 wt %), based on the total weight of the lubricating oil composition.

The oil of lubricating viscosity (sometimes referred to as "base stock" or "base oil") is the primary liquid constituent of a lubricant, into which additives and possibly other oils are blended, for example to produce a final lubricant (or lubricant composition). A base oil, which is useful for making concentrates as well as for making lubricating oil compositions therefrom, may be selected from natural (vegetable, animal or mineral) and synthetic lubricating oils and mixtures thereof.

Definitions for the base stocks and base oils in this disclosure are the same as those found in American Petroleum Institute (API) Publication 1509 Annex E ("API Base Oil Interchangeability Guidelines for Passenger Car Motor Oils and Diesel Engine Oils," December 2016). Group I base stocks contain less than 90% saturates and/or greater than 0.03% sulfur and have a viscosity index greater than or equal to 80 and less than 120 using the test methods specified in Table E-1. Group II base stocks contain greater than or equal to 90% saturates and less than or equal to 0.03% sulfur and have a viscosity index greater than or equal to 80 and less than 120 using the test methods specified in Table E-1. Group Ill base stocks contain greater than or equal to 90% saturates and less than or equal to 0.03% sulfur and have a viscosity index greater than or equal to 120 using the test methods specified in Table E-1. Group IV base stocks are polyalphaolefins (PAO). Group V base stocks include all other base stocks not included in Group I, II, Ill, or IV.

Natural oils include animal oils, vegetable oils (e.g., castor oil and lard oil), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Synthetic oils include hydrocarbon oil. Hydrocarbon oils include oils such as polymerized and interpolymerized olefins (e.g., polybutylenes, polypropylenes, propylene isobutylene copolymers, ethylene-olefin copolymers, and ethylene-alphaolefin copolymers). Polyalphaolefin (PAO) oil base stocks are commonly used synthetic hydrocarbon oil. By way of example, PAOs derived from $C_8$ to $C_{14}$ olefins, e.g., $C_8$, $C_{10}$, $C_{12}$, $C_{14}$ olefins or mixtures thereof, may be utilized.

Other useful fluids for use as base oils include non-conventional or unconventional base stocks that have been processed, preferably catalytically, or synthesized to provide high performance characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

Base oils for use in the lubricating oil compositions of present disclosure are any of the variety of oils corresponding to API Group I, Group II, Group Ill, Group IV, and Group V oils, and mixtures thereof, preferably API Group II, Group Ill, Group IV, and Group V oils, and mixtures thereof, more preferably the Group Ill to Group V base oils due to their exceptional volatility, stability, viscometric and cleanliness features.

Typically, the base oil will have a kinematic viscosity at 100° C. (ASTM D445) in a range of 2.5 to 20 $mm^2/s$ (e.g., 3 to 12 $mm^2/s$, 4 to 10 $mm^2/s$, or 4.5 to 8 $mm^2/s$).

The present lubricating oil compositions may also contain conventional lubricant additives for imparting auxiliary functions to give a finished lubricating oil composition in which these additives are dispersed or dissolved. For example, the lubricating oil compositions can be blended with antioxidants, ashless dispersants, anti-wear agents, detergents such as metal detergents, rust inhibitors, dehazing agents, demulsifying agents, friction modifiers, metal deactivating agents, pour point depressants, viscosity modifiers, antifoaming agents, co-solvents, package compatibilizers, corrosion-inhibitors, dyes, extreme pressure agents and the like and mixtures thereof. A variety of the additives are known and commercially available. These additives, or their analogous compounds, can be employed for the preparation of the lubricating oil compositions of the invention by the usual blending procedures.

Each of the foregoing additives, when used, is used at a functionally effective amount to impart the desired properties to the lubricant. Thus, for example, if an additive is an ashless dispersant, a functionally effective amount of this ashless dispersant would be an amount sufficient to impart the desired dispersancy characteristics to the lubricant. Generally, the concentration of each of these additives, when used, may range, unless otherwise specified, from about 0.001 to about 20 wt %, such as about 0.01 to about 10 wt %.

The following illustrative examples are intended to be non-limiting.

EXAMPLES

Engine Test 1

A Ford 2.0-L EcoBoost 4-cylinder gasoline turbocharged direct-injection engine was used for LSPI testing. In this setup, each cylinder was outfitted with a pressure transducer to monitor in-cylinder pressure.

A four-segment test procedure was used to determine the number of LSPI events across all four cylinders at an engine speed of 1750 rpm at a load of 269 N-m. Each segment was 3.25 hours, separated by 15 min of light load operation at 2000 rpm and 50 N-m. LSPI frequency during the last two segments is reported for comparison; and the first two segments are not considered due to engine oil conditioning. To account for LSPI activity during transient conditions, the beginning of each segment is filtered, or removed, to allow for comparisons of activity during steady state operation only. This truncation typically results in the removal of approximately 4,000 cycles per cylinder per segment.

During testing, both combustion pressure and phasing were monitored for each cylinder. An LSPI event occurred when two criteria were achieved: 1) peak cylinder pressure exceeded five standard deviations from the mean peak pressure; and 2) combustion phasing (CA5, or the crank angle at which 5% heat release occurs) advanced more than five standard deviations from the mean CA5.

LSPI frequency is reported as the average number of events per cylinder over one million cycles. Unadditized 49-state premium unleaded gasoline was used to establish baseline LSPI activity before and after an LSPI-mitigating additive test. The reported change in LSPI frequency is the percentage difference with respect to the pre- and post-baseline runs. The engine oil used during testing met ILSAC GF-5 and API SN specifications.

Base fuel information: FR62180-49 state unadditized PUL fuel.

The treat rate in the three examples shown below is 300 ppmw in fuel. (For 2,4,6-tris(dimethyl aminomethyl)phenol+1,8-diazabicyclo[5.4.0]-undeca-7-ene (DBU), it is 1:1 molar ratio and with the total of 300 ppmw).

LSPI events reduction results are shown in Table 1 below.

TABLE 1

| Additives | LSPI events reduction (%) |
|---|---|
| 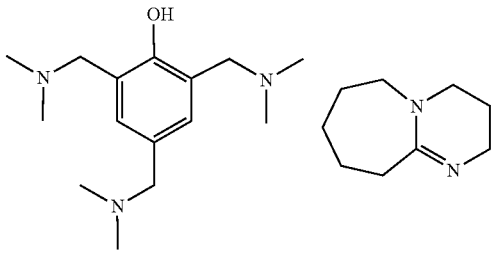 2,4,6-tris(dimethyl aminomethyl)phenol + DBU | 51% |

TABLE 1-continued

| Additives | LSPI events reduction (%) |
|---|---|
| 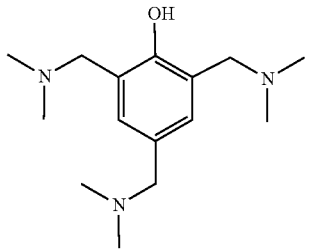 2,4,6-tris(dimethyl aminomethyl)phenol | 40% |
| 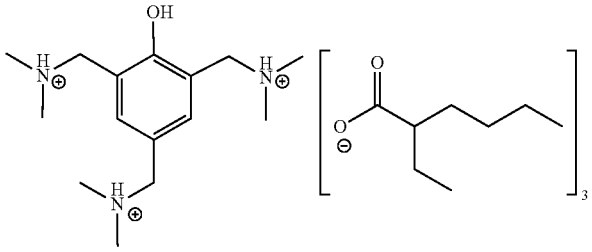 Salt of 2,4,6-tris(dimethyl aminomethyl)phenol and 2-ethylhexanoate | 27% |

LSPI reduction is with respect to neighboring, or local, baseline test values.

Engine Test 2

A 4-GM 2.0-L Ecotec 4-cylinder gasoline turbocharged direct-injection engine was used for LSPI testing. In this setup, each cylinder was outfitted with a pressure transducer to monitor in-cylinder pressure.

A six-segment test procedure was used to determine the number of LSPI events across all four cylinders at an engine speed of 2000 rpm at a load of 290 N-m. Each segment was 28 minutes, separated by an idle period at low engine speed and load. LSPI frequency during segments two through six are reported for comparison; and the first segment was not considered due to engine oil conditioning.

To account for LSPI activity during transient conditions, the beginning of each segment was filtered, or removed, to allow for comparisons of activity during steady state operation only. This truncation typically resulted in the removal of approximately 4,000 cycles per cylinder per segment leading to approximately 100,000 measured cycles per segment (or 25,000 cycles per cylinder).

During testing, both combustion pressure and phasing were monitored for each cylinder. An LSPI event occurred when two criteria were achieved: 1) peak cylinder pressure exceeded five standard deviations from the mean peak pressure and 2) combustion phasing (CA5, or the crank angle at which 5% heat release occurs) advanced more than five standard deviations from the mean CA5. Unadditized 49-state premium unleaded gasoline was used to establish baseline LSPI activity before and after an LSPI-mitigating additive test. Base fuel information: FR62180-49 state unadditized PUL fuel. The engine oil used during testing met ILSAC GF-5 and API SN specifications.

LSPI frequency is reported as the average number of events per cylinder over one million cycles. The reported change in LSPI frequency is the percentage difference with respect to the pre- and post-baseline runs.

The treat rate in the examples shown below is 1000 ppmw in fuel. (primary additive+secondary additive [1,8-diazabicyclo[5.4.0]-undeca-7-ene (DBU)], it is 1:1 molar ratio and with the total of 1000 ppmw).

LSPI events reduction results are shown in Table 2 below.

TABLE 2

| Additives | LSPI events reduction (%) |
|---|---|
| 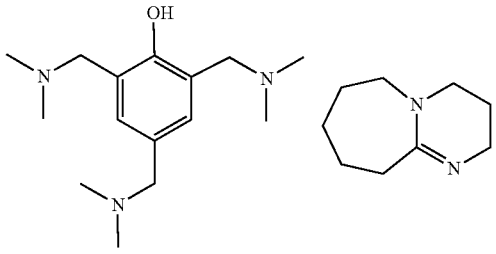 2,4,6-tris(dimethyl aminomethyl)phenol + DBU | 62.5% |
| 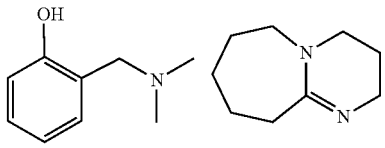 2-[(Dimethylamino)methyl]phenol + DBU | 65.5% |

TABLE 2-continued

| Additives | LSPI events reduction (%) |
|---|---|
| 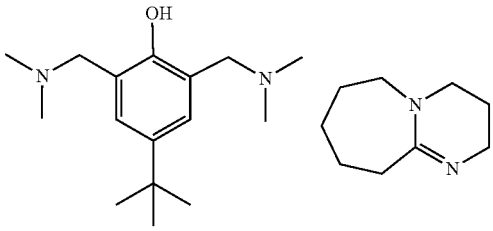 4-(tert-butyl)-2,6-bis((dimethylamino)methyl)phenol + DBU | 88% |
| 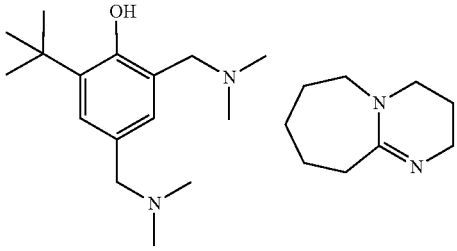 2-(tert-butyl)-4,6-bis((dimethylamino)methyl)phenol + DBU | 89.6% |

The invention claimed is:

1. A method for preventing or reducing low speed pre-ignition events in a spark-ignited internal combustion engine, the method comprising:

supplying to the engine the lubricant composition comprising a primary additive having a structure given by

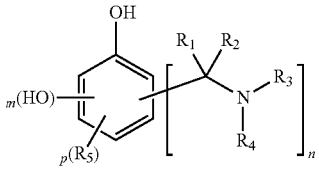

or a salt there of;

wherein $R_1$ and $R_2$ are independently H, $C_1$-$C_{20}$ hydrocarbyl group, carboxyl group, ester, amide, ketone, ether, or hydroxyl group;

wherein $R_3$ and $R_4$ are independently H, $C_1$-$C_{20}$ hydrocarbyl group, carboxyl group, ester, amide, ketone, ether, amino, or hydroxyl group or wherein $R_3$ and $R_4$ are part of a cyclic group;

wherein $R_5$ is $C_1$-$C_{100}$ hydrocarbyl group, carboxyl group, ether, or hydroxyl group;

wherein p is 0 to 2, n is 1 to 5, m is 0 to 2, and p+n+m is less than 6; and a secondary additive, wherein the secondary additive is 2-ethylhexanoic acid, or 1,8-diazabicyclo [5.4.0]-undeca-7-ene.

2. The method of claim 1, wherein the carboxyl group is a carboxylic acid.

3. The method of claim 1, wherein the cyclic group contains one or more nitrogens or one or more oxygens.

4. The method of claim 1, wherein the primary additive is 2,4,6-tris(dimethyl aminomethyl) phenol, 2-[(dimethylamino)methyl]phenol, 4-(tert-butyl)-2,6-or 2-(tert-butyl)-4,6-bis((dimethylamino)methyl)phenol, bis((dimethylamino)methyl)phenol.

5. The method of claim 1, further comprising:

a secondary additive or a salt thereof.

6. The method of claim 5, wherein the secondary additive is an acid, phenol, 1,3 dicarbonyl, hydroxyamide, antioxidant, salicylate, or amidine.

7. The method of claim 1, $R_1$ and $R_2$ are both hydrogen.

8. The method of claim 1, wherein at least one of $R_3$ and $R_4$ is a methyl group.

9. The method of claim 1, wherein n is 2 or 3.

10. A method for preventing or reducing low speed pre-ignition events in a spark-ignited internal combustion engine, the method comprising:

lubricating the engine with a lubricant composition comprising a phenolic amine having a structure given by

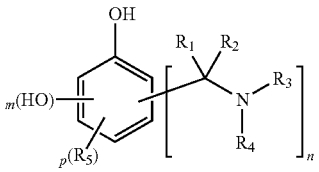

or a salt there of;

wherein $R_1$ and $R_2$ are independently H, $C_1$-$C_{20}$ hydrocarbyl group, carboxyl group, ester, amide, ketone, ether, or hydroxyl group;

wherein $R_3$ and $R_4$ are independently H, $C_1$-$C_{20}$ hydrocarbyl group, carboxyl group, ester, amide, ketone, ether, amino, or hydroxyl group or wherein $R_3$ and $R_4$ are part of a cyclic group;

wherein $R_5$ is $C_1$-$C_{100}$ hydrocarbyl group, carboxyl group, ether, or hydroxyl group;

wherein p is 0 to 2, n is 1 to 5, m is 0 to 2, and p+n+m is less than 6; and a second additive or a salt thereof, wherein the second additive is an 2-ethylhexanoic acid, or 1,8-diazabicyclo [5.4.0]-undeca-7-ene.

11. The method of claim 10, wherein the carboxyl group is a carboxylic acid.

12. The method of claim 10, wherein the cyclic group contains one or more nitrogens or one or more oxygens.

13. The method of claim 10, wherein the phenolic amine is 2,4,6-tris(dimethyl aminomethyl)phenol, 2-[(dimethylamino) methyl]phenol, 4-(tert-butyl)-2,6-bis((dimethylamino)methyl)phenol, or 2-(tert-butyl)-4,6-bis((dimethylamino)methyl)phenol.

14. The method of claim 10, $R_1$ and $R_2$ are both hydrogen.

15. The method of claim 10, wherein at least one of $R_3$ and $R_4$ is a methyl group.

16. The method of claim 10, wherein n is 2 or 3.

* * * * *